United States Patent [19]

Matsuura et al.

[11] 4,411,765

[45] Oct. 25, 1983

[54] METHOD FOR LIQUEFYING LOW RANK COAL

[75] Inventors: Yoshio Matsuura, Funabashi; Michio Kurihara, Mitaka; Takao Kamei, Ashiya; Akira Nakamura; Keiichi Komai, both of Akashi; Takeshi Wakabayashi, Kobe, all of Japan

[73] Assignees: Electric Power Development Co., Tokyo; Kawasaki Kabushiki Kaisha, Kobe, both of Japan

[21] Appl. No.: 347,422

[22] Filed: Feb. 10, 1982

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS

| | | | |
|---|---|---|---|
| 3,764,547 | 10/1973 | Schlinger et al. | 48/206 X |
| 4,101,413 | 7/1978 | Jones | 208/8 LE |
| 4,125,452 | 11/1978 | Effron | 208/8 LE |
| 4,313,819 | 2/1982 | Rado | 208/8 LE X |

FOREIGN PATENT DOCUMENTS 32607 11/1972 Australia .

*Primary Examiner*—Delbert E. Gantz
*Assistant Examiner*—William G. Wright
*Attorney, Agent, or Firm*—Kerkam, Stowell, Kondracki & Clarke

[57] ABSTRACT

An economical method for liquefying low rank coal is proposed. The method comprises steps of providing water-coal slurry by mixing crushed coal with water, heating the slurry under a pressure to a temperature which is lower than the saturated temperature under the pressure to thereby remove water from the coal with a result that coal content in the slurry be decreased, separating liquid in the slurry from solids, performing heat exchange between the separated liquid and the said pressurized water-coal slurry, then mixing the liquid with crushed coal to provide a further water-coal slurry, mixing the separated solids with a solvent to provide a fluid, evaporating water contents in the fluid, cooling the evaporated water to thereby condense it so as to recover volatile material, heating and pressurizing residual part of the fluid to a temperature and pressure suitable for liquefaction reaction with addition of hydrogen to obtain a liquefaction reactant then subjecting the reactant to a heat exchange with the water-coal slurry to cool the reactant to a temperature suitable for distillation, recirculating at least a part of the liquefaction reactant so that it is used at least a part of the solvent.

5 Claims, 2 Drawing Figures

METHOD FOR LIQUEFYING LOW RANK COAL

Figure 1:
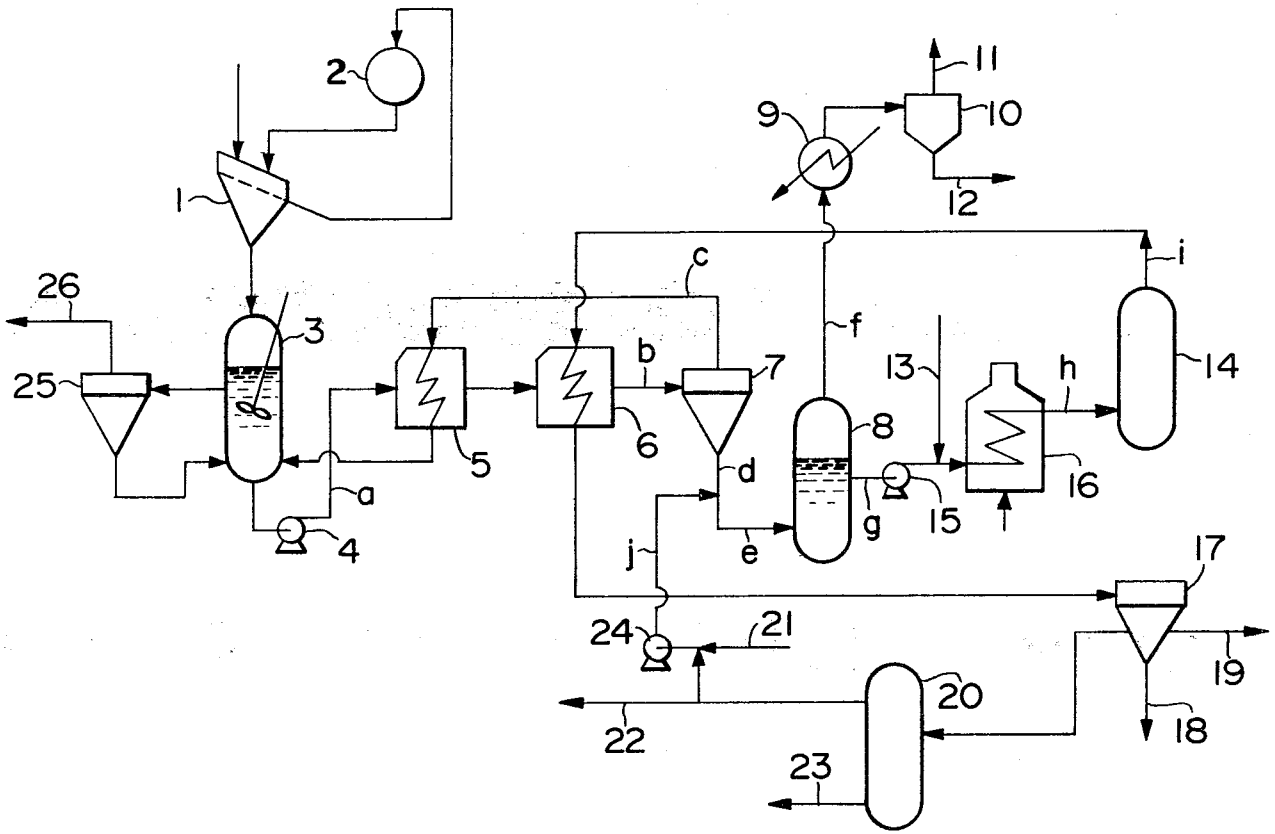

The present invention concerns a liquefying method for low rank coals (hereinafter called "brown coal") containing a high rate of water, such as brown coal, lignite and subbituminous coal, or to be more specific, a method for liquefying such coals by effectively dehydrating them and at the same time making efficient use of pressure and heat required for the dehydration and liquefaction processes in a reciprocal manner.

Up to the present, numerous methods for liquefying coals have been proposed. In such known art, methods to vaporize water content are adopted to remove the water contained in coal as a pretreatment for liquefaction. In other words, coals are mixed with solvent required for liquefaction reaction after the water content therein is evaporated by a fluidized bed dryer, etc. or the water content of coals is evaporated by mixing coals with very hot solvent or by heating a fluid mixture of coals and solvent. These evaporation dehydrating methods require a vast amount of latent heat for evaporating the water content so that they are economically disadvantageous and especially have problems in case of coals with a low rank in coalification and high water content like brown coal. For example, a certain kind of brown coal produced in Australia contains water at a rate of 2 kg vs. 1 kg brown coal. Calorie necessary for evaporating the water content amounts to 25% of a calorific value of the brown coal. Brown coal and other coals with a low rank in coalification abundantly contain carboxyl group, hydroxyl group, carbonyl group and other oxygen-containing functional groups and has a high oxygen-containing ratio. Therefore, when trying to fluidize such coal by mixing with oily liquid as a pre-treatment for liquefaction reaction, various problems are encountered. For instance, whereas most of the hydrocarbon composing brown coal and other coals is wettable with oil, acid-containing functional group such as the carboxyl group is hydrophilic with little affinity for oil liquid, resulting in instable fluid conditions. For stabilizing the fluid, a large amount of surface active agent should be consumed. Furthermore, during the liquefaction reaction, the oxygen content becomes water by reacting with hydrogen in the solvent, wasting expensive hydrogen.

An object of the present invention is therefore to provide a liquefying method for low rank coal which can solve the above-mentioned problems.

Another object of the present invention is to provide a liquefying process for low rank coal which effectively utilizes a phenomenon in which water content in coals can be removed in liquid form by heating it in a non-evaporating atmosphere.

A further object of the present invention is to provide a liquefying method for low rank coal in which consumptions for heat, hydrogen and other additives can be significantly decreased.

According to the present invention, the above and other objects can be accomplished by a method for liquefying low rank coal which comprises steps of providing water-coal slurry by mixing crushed coat with water, heating the slurry under a pressure to a temperature which is lower than the saturated temperature under the pressure to thereby remove water from the coal with a result that coal content in the slurry be decreased, separating liquid in the slurry from solids, performing heat exchange between the separated liquid and a pressurized water-coal slurry, then mixing the liquid with crushed coal to provide a further water-coal slurry, mixing the separated solids with a solvent to provide a fluid, evaporating water content in the fluid, cooling the evaporated water to thereby condense it so as to recover volatile material, heating and pressurizing residual part of the fluid to a temperature and pressure suitable for liquefaction reaction with addition of hydrogen to obtain a liquefaction reactant then subjecting the reactant to a heat exchange with the water-coal slurry to cool the reactant to a temperature suitable for distillation, recirculating at least a part of the liquefaction reactant so that it is used at least a part of the solvent. The evaporating step of the water content in the fluid may be carried out by depressurizing the fluid or applying heat from the solvent.

In a preferable mode of the present invention, the evaporated water is subjected to a heat-exchange with the water-coal slurry to be cooled and condensed thereby and at the same time to preheat the slurry.

Figure 2:
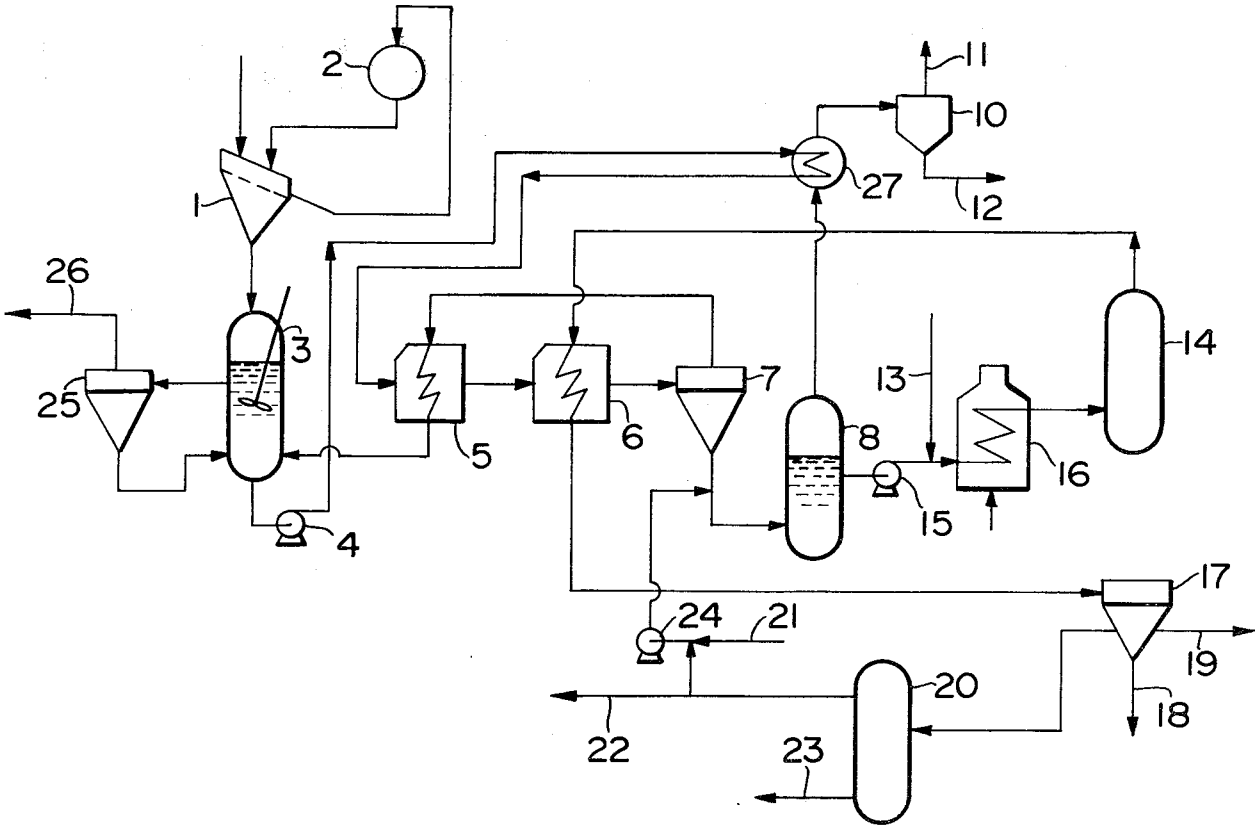

The above and other objects and features of the present invention will become apparent from the following descriptions taking reference to the accompanying drawings, in which;

FIG. 1 is a flow sheet indicating a preferred embodiment to perform the method according to the present invention; and FIG. 2 is a flow sheet indicating another embodiment to perform the method according to the present invention.

Referring now to the drawings, particularly to FIG. 1, raw brown coal is crushed, classified and adjusted by a classifier 1 such as a vibrating screen and a crusher 2 such as a wet mill and then it is mixed with the below-mentioned waste water (separated water) and stirred in a stirring tab 3 to form water-brown coal slurry. The water-brown coal slurry is pressurized to, for example, 50 kg/cm$^2$ G by a pump 4 and then fed to a heat exchange apparatus 5 and 6 were its temperature is raised to a level lower than the saturation temperature under the above-mentioned high pressure of 50 kg/cm$^2$ G, which is for example around 260° C., and the water content of the brown coal is dehydrated in the state of liquid. The water-brown coal slurry of which the density is reduced by dehydration and the viscosity is lowered by raise of the temperature is introduced to a solid-liquid separator 7 such as a cyclone and separated to water and brown coal concentrate phase. After the separated water introduced to the heat exhange apparatus 5 exchanges heat with the water-brown coal slurry pressurized by the above-mentioned pump 4, it is introduced to the aforementioned stirring tab 3 where it is mixed with crushed brown coal, thus serving as the water supply source for the water-brown coal slurry. On the other hand, the separated brown coal concentrate phase is mixed with solvent consisting of oil produced by liquefaction as mentioned below. The fluid thus prepared is fed to a gas-liquid separator 8. The pressure inside the separator 8 being slightly reduced beforehand (below the saturation pressure of the water at the temperature of the water-brown coal slurry), the water left in the fluid is evaporated to further reduce the water content. In the event solvent consisting of oil resulted from liquefaction has a high temperature, dehydration of the water content left in the fluid is possible by evaporation with heat held in the solvent as the heat source. In order to improve the dehydration rate further, the pressure inside the gas-liquid separator can be slightly reduced even if the temperature of the solvent is high enough. The gas phase separated by the gas-liquid separator 8 is cooled by a condenser 9 and the water content is condensed enabling to recover a volatile product (partly including exhaust gas). 10 represents a gas-liquid separator, 11 a recovery pipe for volatile products and 12 an extraction pipe for waste water. Although the fluid from the gas-liquid separator 8, namely, oil-brown coal slurry has a sufficiently high temperature and high pressure, if necessary, it should be further heated so as to reach a temperature and pressure suitable for liquefaction reaction, and with a necessary amount of hydrogen added through a hydrogen supply pipe the fluid is fed to a liquefaction reactor 14 for liquefaction. 15 represents a pressure pump and 16 a heater. The liquefaction reactant introduced to the above-mentioned heat exchange apparatus 6 exchanges heat with water-brown coal slurry so that the temperature of the water-brown coal slurry are elevated and the temperature of the liquefaction reactant are lowered to an appropriate level for distillation. Subsequently, the liquefaction reactant is introduced into a solid-liquid separator 17 and separated into liquefaction reactant, solid liquefaction residue and water produced during the liquefaction process. 18 represents an extraction pipe for liquefaction residue and 19 an extraction pipe for waste water. Liquefaction reactant oil such as light oil or heavy oil is obtained from liquefaction reactant fed to a distilling column 20 and distilled. At least part of the liquefaction reactant oil such as light oil is circulatively used as at least part of the above-mentioned solvent for preparing oil-brown coal slurry. Besides the case, in which only liquefaction reactant oil is used as solvent, liquefaction reactant oil is also used together with solvent supplied through a solvent supply pipe for liquefaction 21. 22 represents a light oil extraction pipe, 23 a heavy oil extraction pipe and 24 a pump. It is also possible that hydrogen is produced from liquefaction residue separated by the solid-liquid separator 17 with known gasification art for use as the hydrogen source for the liquefaction process. The leftover water at the preparation of water-brown coal slurry in the stirring tab 3 is fed to a solid-liquid separator 25 such as a cyclone, and is discarded through a waste water extraction pipe 26 after brown coal particles are separated and recovered. If an operational temperature of the liquid dehydration process high, the dehydration rate becomes also high accordingly and almost anhydrous coal can be obtained. However, since water is retained between the dehydrated coal particles, it is preferred that means to remove water retained between particles such as the gas-liquid separator 8 is provided. If an operational pressure during the liquid dehydration process is set at the operational pressure in the liquefaction process plus the pressure reduced in the above-mentioned gas-liquid separator 8, etc., pressurizing and heating before the liquefaction process can be omitted. In any case, since the water-brown coal slurry after the liquid dehydration process keeps a high temperature and a high pressure, a substantial amount of energy required to get high temperature and high pressure that is necessary in the liquefaction process can be saved.

Another preferred embodiment according to the present invention will be described in reference to FIG. 2. In this embodiment, the gas phase separated from the fluid (oil-brown coal slurry) in the gas-liquid separator 8 exchanges heat in the heat exchange apparatus 27 with the water-brown coal slurry pressurized by the pump 4 so that the gas phase is cooled, separated and condensed while the water-brown coal slurry is preheated, resulting in more efficient use of heat. All the other structure and operations are the same as indicated in FIG. 1.

The present invention having the feature as mentioned above, in the dehydration process as a pretreatment, when brown coal is heated in the non-evaporation atmosphere, the water content is dehydrated in the state of liquid, enabling to save more than a half of energy consumed by dehydration with the conventional methods. Furthermore, as the separated water and liquefaction reactant both of which have high temperatures are used as the heat source for the water-brown coal slurry, only a small amount of calorie should be added from outside the system, ensuring a great economic saving. The water-brown coal slurry produced through the dehydration process does not suffer from temperature loss caused by evaporation because the water is separated in the state of liquid by a solid-liquid separator 7 such as a cyclone and its viscosity is small because of the high temperature. In addition to the above two favorable conditions, the lowered density resulted from dehydrated content contributes to efficient solid-liquid separation. On account of the efficient solid-liquid separtion as explained above, the amount of water vaporized in the gas-liquid separator 8 in the subsequent process is decreased so that the temperature and pressure are only slightly lowered at the gas-liquid separator 8 and the slurry from the gas-liquid separator maintains a high temperature and a high pressure, resulting in a less amount of energy to be added when it is introduced to the liquefaction process. Therefore, this method is far more advantageous than the conventional methods to liquefy dehydrated coal produced with the evaporation drying method or the liquid dehydration method. On the other hand, the water separated from water-brown coal slurry is returned to the stirring tab 3 through the heat exchange apparatus 5, during which process its sensible heat is sufficiently recovered. Furthermore, since at least part of light oil, etc. produced in the liquefaction process is used as solvent to be added for the liquefaction, and additive hydrogen is also made by using the residue in the liquefaction process, necessity of introducing a large quantity of additive oil (solvent) and hydrogen from outside is eliminated, resulting in a highly economical operation. Through the dehydration process the brown coal loses part of the oxygen content due to reduction of oxygen-containing groups, a phenomenon characteristic of the liquid dehydration, so that of the hydrogen added in the liquefaction process the amount to be consumed in reacting with oxygen is lowered. At the same time, the dehydrated coal getting more wettable with oil facilitates preparation of oil-brown coal slurry.

In the above embodiment, the solvent extraction method is used as the method for liquefaction. However, adoption of other liquefaction methods such as the direct hydrogenating method combined with the liquid dehydration method according to the present invention as a pretreatment will have a similar effect.

The following is an example of the present invention.

Raw brown coal with 63% water content was crushed and fed to a stirring tab at a rate of 100 kg/hr. and experiment was made with the structure shown in FIG. 1. The following table indicated the flow rate at each spot (a–j).

| Sample Collected at | Flow Rate (Material Balance) Brown Coal Coal Content kg/hr | Brown Coal Water Content kg/hr | Water kg/hr | Oil kg/hr | Hydrogen kg/hr | Liquefaction Products and Others kg/hr | Remarks |
|---|---|---|---|---|---|---|---|
| a | 37.2 | 62.8 | 100.00 | — | — | — | Brown coal water content 63% Slurry density 50% |
| b | 37.2 | 0 | 162.8 | — | — | — | Brown coal water content 0 Slurry density 19% |
| c | 7.7 | 0 | 154.0 | — | — | — | |
| d | 29.5 | 0 | 8.8 | — | — | — | Slurry density 77% |
| e | 29.5 | 0 | 8.8 | 29.5 | — | — | Slurry density 43% |
| f | 0 | 0 | 8.8 | 1.5 | — | — | |
| g | 29.5 | 0 | 0 | 28.0 | — | — | |
| h | 29.5 | 0 | 0 | 28.0 | 12.4 | — | |
| i | — | — | — | — | — | 69.9 | |
| j | — | — | — | 29.5 | — | — | |

As described above, since the method according to the present invention adopts liquid dehydration, calorie and hydrogen are consumed less than conventional process and high temperature and high pressure maintained in the dehydration process can be used in the liquefaction process, resulting in saving the energy consumption. Moreover, the hot water produced by liquid dehydration being used for preheating the water-brown coal slurry, together with the liquid dehydration itself, contributes to excellent thermal economization. After recovery of heat from the hot water, part of the water is used as the water source for preparing water-brown coal slurry. On the other hand, since liquefaction reactant oil having a high temperature is used as extraction solvent in the liquefaction process, all in all the present invention effectively achieves remarkable energy saving.

The invention has thus been shown and described with reference to specific embodiments, however, it should be noted that the invention is in no way limited to the details of the described processes but changes and modifications may be made without departing from the scope of the appended claims.

We claim:

1. Method for liquefying low rank coal which comprises steps of providing a water-coal slurry by mixing crushed coal with water, heating the slurry under a pressure to a temperature which is lower than the saturation temperature under the pressure to thereby remove water from the coal in the liquid phase, separating liquid in the slurry from the solids, performing heat exchange between the separated liquid and the said pressurized water-coal slurry, then mixing the liquid with crushed coal to provide a further water-coal slurry, mixing the separated solids with a solvent to provide a fluid, evaporating the water content of the fluid, cooling the evaporated water to thereby condense it so as to recover volatile material, heating and pressurizing a residual part of the fluid to a temperature and pressure suitable for liquefaction reaction with addition of hydrogen to obtain a liquefaction reactant, then subjecting the reactant to a heat exchange with the water-coal slurry to cool the reactant to a temperature suitable for distillation, and recirculating at least a part of the liquefaction reactant so that it is used as at least a part of the solvent.

2. Method in accordance with claim 1 in which the evaporated water is subjected to a heat-exchange with the water-coal slurry to be cooled and condensed thereby and at the same time to thereby preheat the slurry.

3. Method in accordance with claim 1 in which said evaporating step of the water content in the fluid is carried out by depressurizing the fluid.

4. Method in accordance with claim 1 in which said evaporating step of the water content in the fluid is carried out by supplying heat thereto from the solvent.

5. Method in accordance with claim 1 in which said evaporating step of the water content in the fluid is carried out both by depressurizing the fluid and by supplying heat thereto from the solvent.

* * * * *